US011940238B2

(12) United States Patent
Robinson et al.

(10) Patent No.: US 11,940,238 B2
(45) Date of Patent: Mar. 26, 2024

(54) CAM SLOT FOR FIREARM

(71) Applicant: WHG Properties, LLC, North Wales, PA (US)

(72) Inventors: Frank Robinson, Schwenksville, PA (US); William Geissele, Lower Gwynedd, PA (US)

(73) Assignee: WHG PROPERTIES, LLC, North Wales, PA (US)

( * ) Notice: Subject to any disclaimer, the term of this patent is extended or adjusted under 35 U.S.C. 154(b) by 0 days.

(21) Appl. No.: 17/859,381

(22) Filed: Jul. 7, 2022

(65) Prior Publication Data

US 2024/0011727 A1 Jan. 11, 2024

(51) Int. Cl.
*F41A 3/66* (2006.01)
*F41A 3/26* (2006.01)

(52) U.S. Cl.
CPC . *F41A 3/66* (2013.01); *F41A 3/26* (2013.01)

(58) Field of Classification Search
None
See application file for complete search history.

(56) References Cited

U.S. PATENT DOCUMENTS 8,234,808 B2 8/2012 Lewis et al.
10,415,906 B2 9/2019 Sullivan et al.
10,488,128 B2 11/2019 Leitner-Wise
10,982,916 B1 4/2021 Sugg
11,035,632 B1 6/2021 Sugg
2020/0124365 A1 4/2020 Bratic

FOREIGN PATENT DOCUMENTS

EP 3298340 B1 12/2019

OTHER PUBLICATIONS

Quick Tip: What Is AR-15 "Dwell Time"? (Youtube video dated Apr. 20, 2022; https://www.youtube.com/watch?v=E4VeOgSQiDI) (Year: 2022).*
Extended European Search Report for EP Patent Application No. 23176330.1 dated Nov. 27, 2023 (8 pages).

* cited by examiner

*Primary Examiner* — Reginald S Tillman, Jr.
(74) *Attorney, Agent, or Firm* — Alston & Bird LLP

(57) ABSTRACT

Provided herein are bolt carriers, firearms, and related methods, devices, and assemblies. A bolt carrier for a firearm of an example embodiment includes a cam slot configured to receive a cam pin of a bolt, the cam slot defining a cam path along which the cam pin is configured to travel, the cam path comprising a locked dwell, an unlocked dwell, and a transition section disposed between the locked dwell and the unlocked dwell, wherein the locked dwell defines a portion parallel to a first axis of the bolt carrier that is greater than 0.070 inches long.

20 Claims, 7 Drawing Sheets

CAM SLOT FOR FIREARM

TECHNOLOGICAL FIELD

Example embodiments relate generally to firearms, and, more particularly, to a modified cam slot configured to delay unlocking of the bolt from the time of firing of a round with the firearm. Associated apparatuses, systems, and methods are also provided.

BACKGROUND

Tactical rifles and other types of firearms may be equipped with a barrel and bolt that, in conjunction, hold or support a cartridge during operation of the firearm (e.g., with a chamber). A magazine contains the cartridges that are fed from the magazine to the chamber during operational cycles. Actuation of the operational cycle of the firearm may be performed manually by an operator (e.g., a bolt action rifles) or by way of an autoloading action (e.g., automatic or semi-automatic rifles), such as a high-pressure propellant gas.

The firearm may integrate the barrel into a barrel assembly (e.g., with or without a barrel extension) which may include locking lugs that engage corresponding lugs of the firearm's bolt. Some firearms may utilize a rotating bolt operation to lock the bolt in place and prevent the bolt carrier group from being driven backwards while the gas from firing of a round is still highly pressurized within the firearm. The rotational and translational movement required to engage and releasably interlock the bolt with the barrel of the firearm via the lugs is controlled by interaction of cam slot with a cam pin that is operably attached to the bolt. The inventors have identified numerous deficiencies with standard cam slots and these existing technologies in the field, the remedies for which are the subject of the embodiments described herein.

BRIEF SUMMARY

In general, embodiments of the present disclosure provided herein include modified cam slots, bolt carriers, bolt carrier groups, firearms, and improved methods for manufacturing and using such modified cam slots. In accordance with one exemplary embodiment of the present disclosure, a bolt carrier for a firearm is provided, the bolt carrier defining a cam slot configured to receive a cam pin of a bolt, the cam slot being defined between an interior of the bolt carrier and an exterior of the bolt carrier, wherein the interior of the bolt carrier is configured to receive at least a portion of the bolt therein and to permit the bolt to translate along and rotate about a first axis of the bolt carrier, wherein the cam slot is configured to constrain the translation and rotation of the bolt, the cam slot defining a cam path along which the cam pin is configured to travel, the cam path comprising a locked dwell, an unlocked dwell, and a transition section disposed between the locked dwell and the unlocked dwell, and wherein the locked dwell defines a portion parallel to the first axis that is greater than 0.070 inches long. The cam slot of an example embodiment is shaped according to an AR15 or M16 Technical Data Package except the locked dwell and a relative position of the cam slot on the bolt carrier. In some embodiments, the locked dwell is greater than a standard locked dwell and in still further embodiments, the locked dwell is approximately 0.195 inches. In some embodiments, the cam slot is a single cut cam slot between a muzzle end of the cam slot and a buttstock end of the cam slot and in still further embodiments, the unlocked dwell is formed via a linear cut path on a second axis parallel to the first axis, wherein the locked dwell is formed via a linear cut path on a third axis parallel to the first axis, and wherein the transition section is formed via a cut path between the second axis and the third axis. The transition section of an example embodiments, comprises two parallel sides defining a width of the transition section, the width of the transition section being approximately equal to a width of the locked dwell. In some embodiments, a distance between a buttstock end of the cam slot and a start of the transition section is 0.292 inches.

In accordance with some embodiment of the present disclosures, a firearm comprises a barrel assembly comprising a barrel or a barrel extension defining one or more locking lugs; an upper receiver connected to the barrel assembly; a bolt carrier group disposed within the upper receiver, the bolt carrier comprising: a bolt carrier defining an interior and a cam slot, the cam slot being defined between the interior of the bolt carrier and an exterior of the bolt carrier; and a bolt defining one or more bolt lugs configured to engage with the one or more locking lugs of the barrel assembly, wherein a cam pin is operably coupled to the bolt, wherein at least a portion of the bolt is disposed in the interior of the bolt carrier to permit the bolt to translate along and rotate about a first axis of the bolt carrier, wherein the cam slot is configured to constrain the translation and rotation of the bolt, the cam slot defining a cam path along which the cam pin is configured to travel, the cam path comprising a locked dwell, an unlocked dwell, and a transition section disposed between the locked dwell and the unlocked dwell, and wherein the locked dwell defines a portion parallel to the first axis that is greater than 0.070 inches long. The cam pin of an example embodiment is disposed farther from the one or more bolt lugs than a standard cam pin. In some embodiments, in operation, the bolt is configured to move between a locked position and an unlocked position, wherein in the locked position, the cam pin is configured to be disposed at or proximate a buttstock end of the cam slot, and wherein in the unlocked position, the cam pin is configured to be disposed at or proximate a muzzle end of the cam slot. In still further embodiments, in the locked position, the cam pin is disposed approximately 1.002 inches from a muzzle end of the bolt carrier. In some embodiments, in the locked position, a muzzle end of the bolt carrier is disposed approximately 0.214 inches from a buttstock side of the one or more bolt lugs. In some embodiments, the cam pin is configured to travel at least 0.4 inches along the first axis between the locked position and the unlocked position. The cam slot in an example embodiments is disposed closer to a muzzle end of the bolt carrier than a standard cam slot. In some embodiments, the cam slot is structured according to an AR15 or M16 Technical Data Package except the locked dwell and a relative position of the cam slot on the bolt carrier. In some embodiments, the locked dwell is greater than a standard locked dwell.

In accordance with some embodiment of the present disclosures, a method of manufacturing a bolt carrier comprises milling a cam slot into a bolt carrier, wherein the cam slot is configured to receive a cam pin of a bolt, the cam slot being milled between an interior of the bolt carrier and an exterior of the bolt carrier, wherein the interior of the bolt carrier is configured to receive at least a portion of the bolt therein and to permit the bolt to translate along and rotate about a first axis of the bolt carrier, wherein the cam slot is configured to constrain the translation and rotation of the bolt, the cam slot defining a cam path along which the cam pin is configured to travel, the cam path comprising a locked dwell, an unlocked dwell, and a transition section disposed between the locked dwell and the unlocked dwell, and wherein the locked dwell defines a portion parallel to the first axis that is greater than 0.070 inches long. In some embodiments, milling the cam slot into the bolt carrier comprises making a single cut cam slot between a muzzle end of the cam slot and a buttstock end of the cam slot. In some embodiments, the unlocked dwell is formed via a linear cut path on a second axis parallel to the first axis, wherein the locked dwell is formed via a linear cut path on a third axis parallel to the first axis, and wherein the transition section is formed via a cut path between the second axis and the third axis.

The above summary is provided merely for purposes of summarizing some example embodiments to provide a basic understanding of some aspects of the present disclosure. Accordingly, it will be appreciated that the above-described embodiments are merely examples and should not be construed to narrow the scope or spirit of the present disclosure in any way. It will be appreciated that the scope of the present disclosure encompasses many potential embodiments in addition to those here summarized, some of which will be further described below. Other features, aspects, and advantages of the subject matter will become apparent from the description, the drawings, and the claims.

BRIEF DESCRIPTION OF THE DRAWINGS

Figure 1:
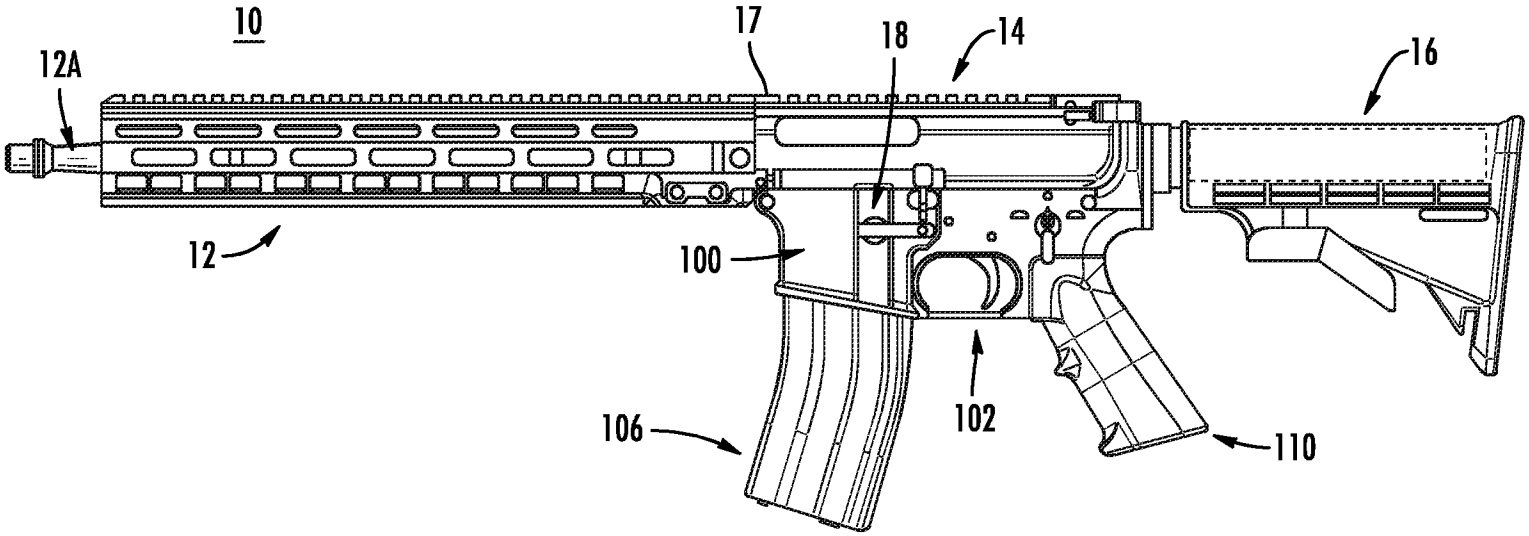

Having thus described embodiments of the present disclosure in general terms above, non-limiting and non-exhaustive embodiments of the subject disclosure will now be described with reference to the accompanying drawings which are not necessarily drawn to scale. The following drawings are illustrative of particular embodiments of the present disclosure and do not limit the scope of the present disclosure. The components illustrated in the accompanying drawings may or may not be present in certain embodiments described herein. Some embodiments may include fewer (or more) components than those shown in the drawings. Some embodiments may include the components arranged in a different way. Moreover, the drawings are intended for use in conjunction with the explanations provided herein. Example embodiments of the present disclosure will hereinafter be described in conjunction with the appended drawings.

Figure 2:
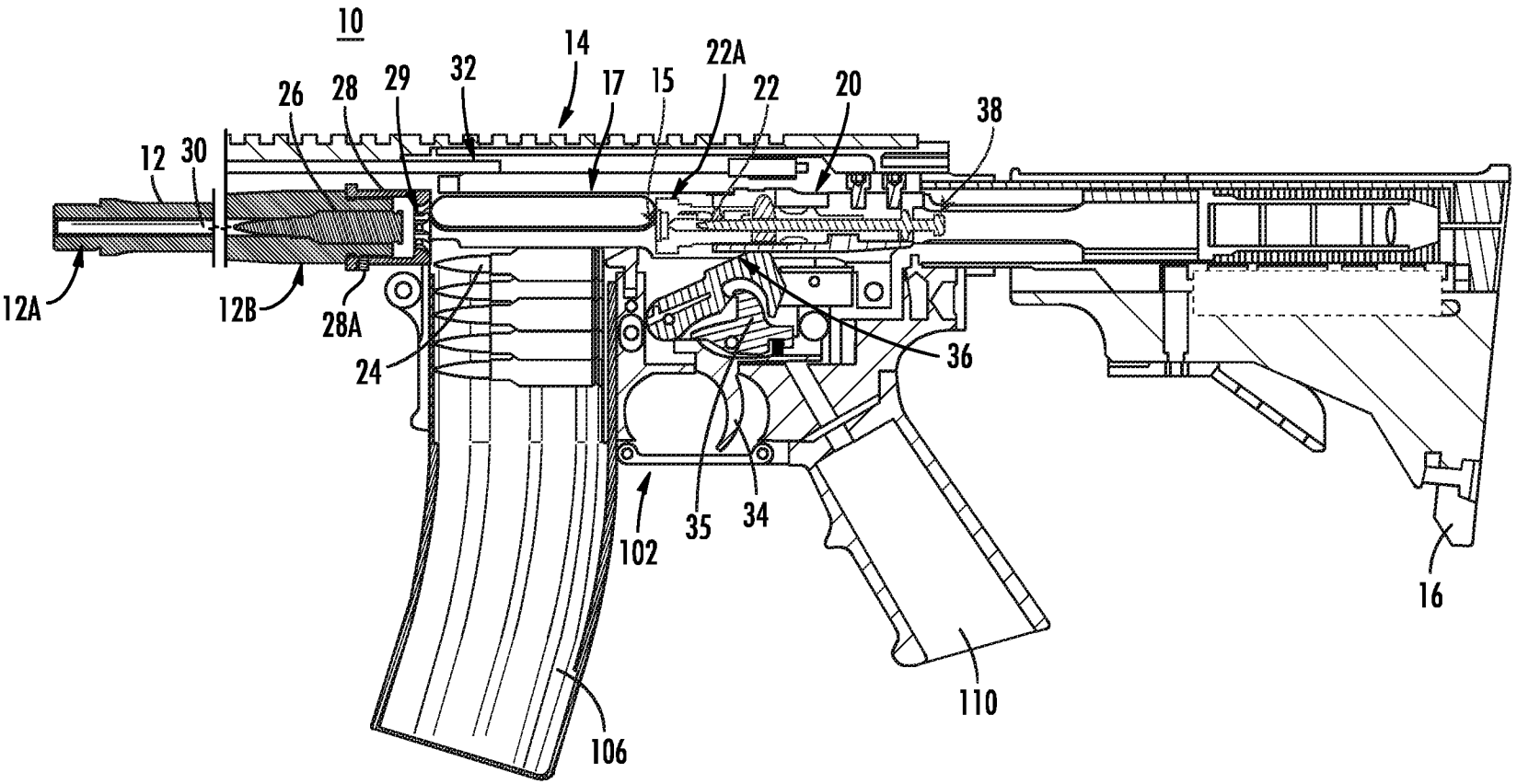
Figure 3:
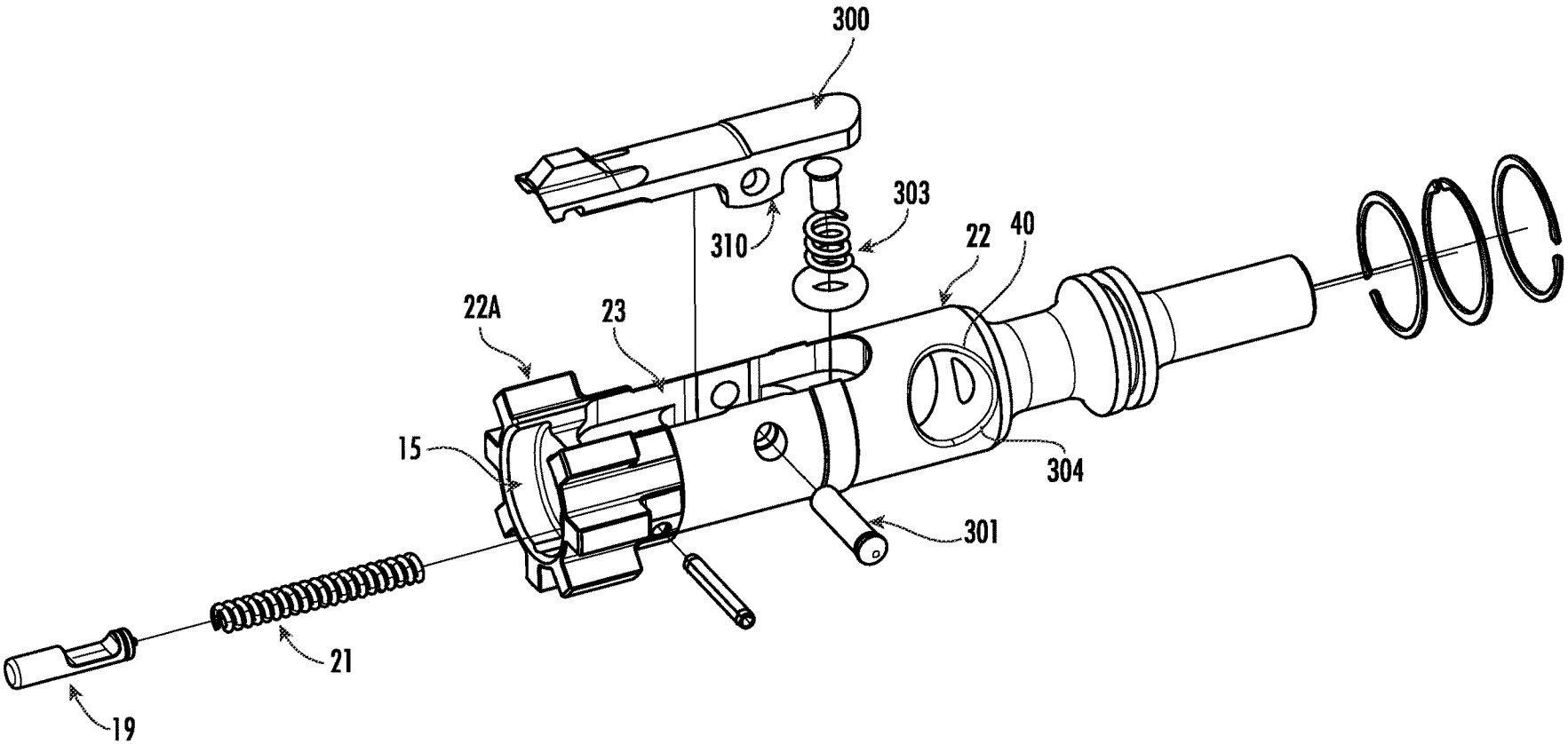
Figure 4A:
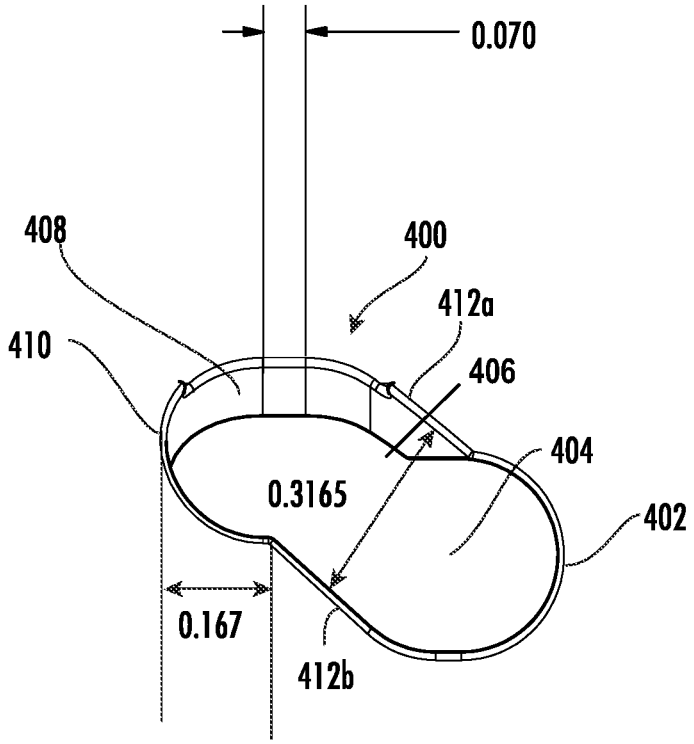
FIG. 4A (PRIOR ART)
Figure 4B:
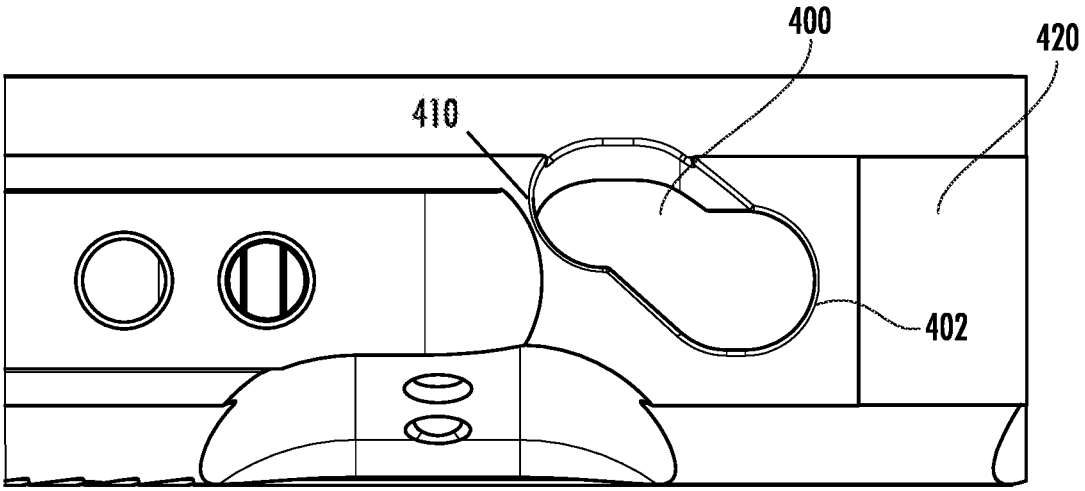
FIG. 4B (PRIOR ART)
Figure 4C:
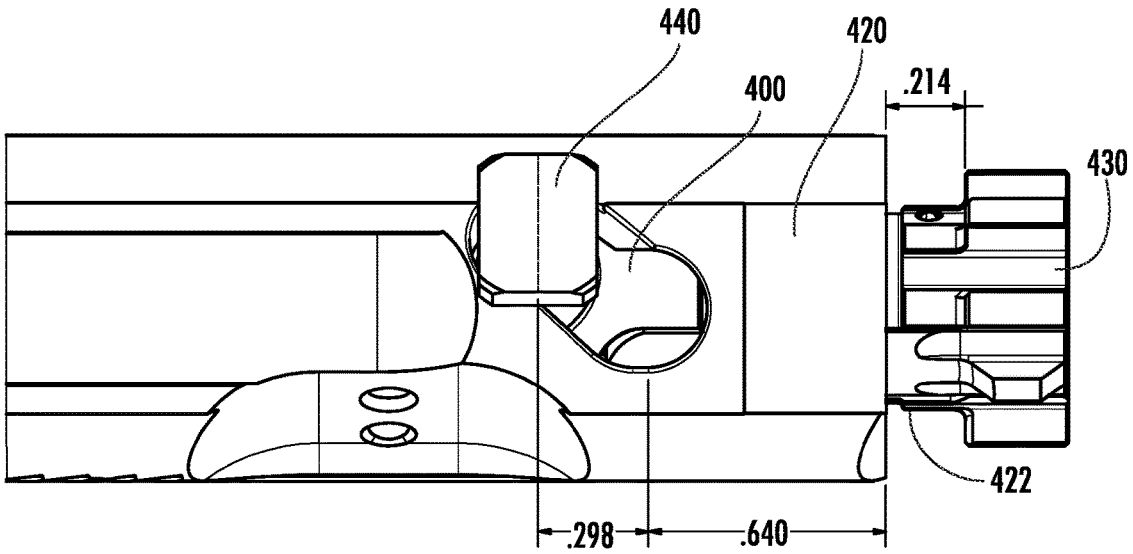
FIG. 4C (PRIOR ART)
Figure 4D:
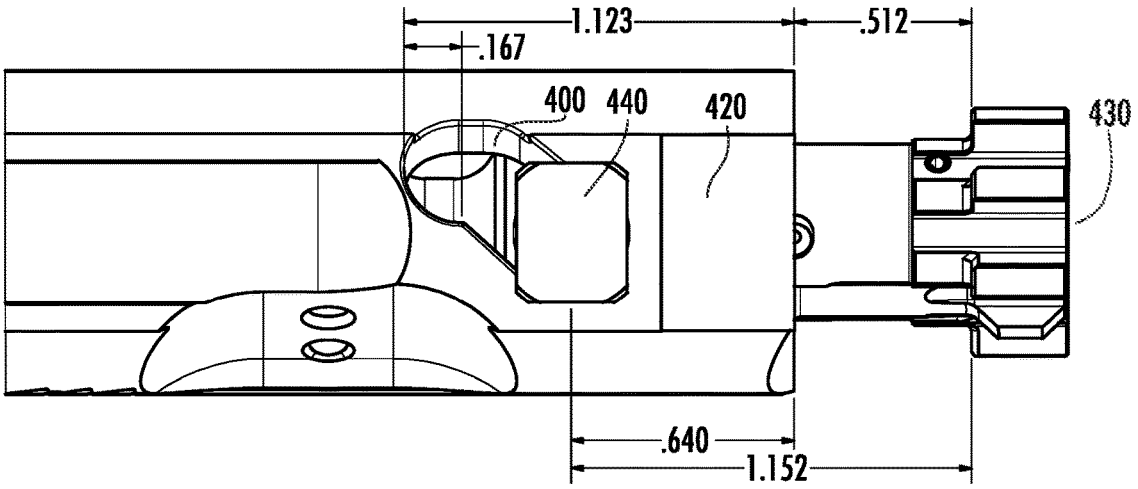
FIG. 4D (PRIOR ART)
Figure 5A:
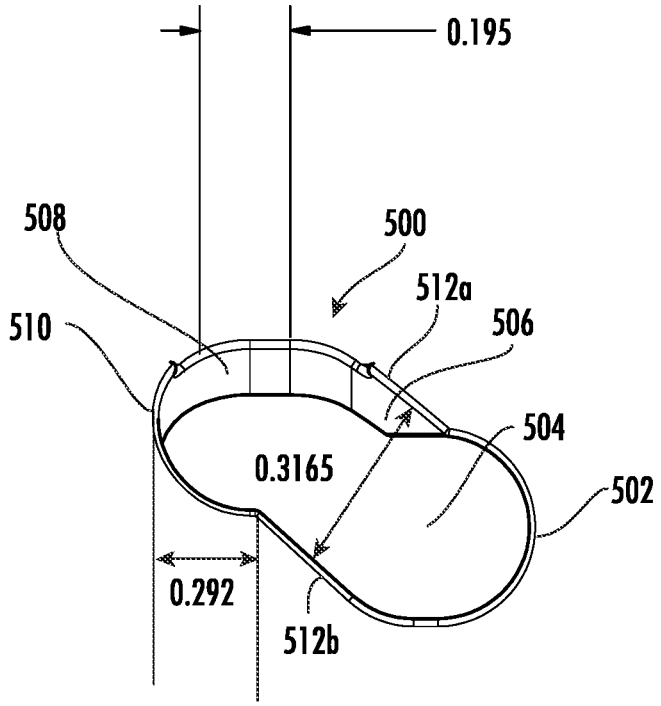
Figure 5B:
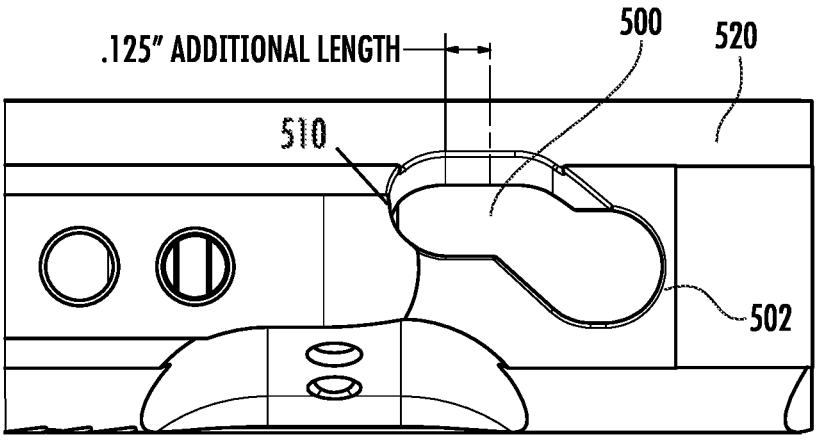
Figure 5C:
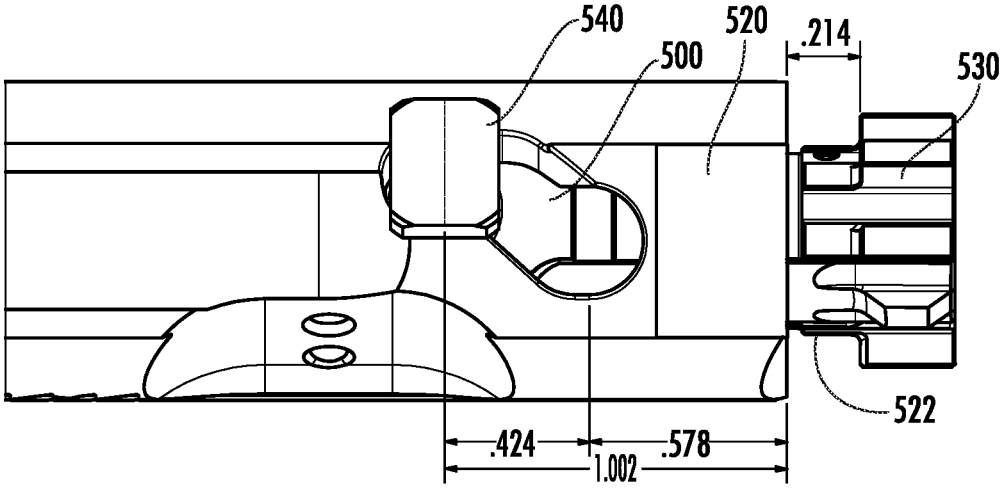
Figure 5D:
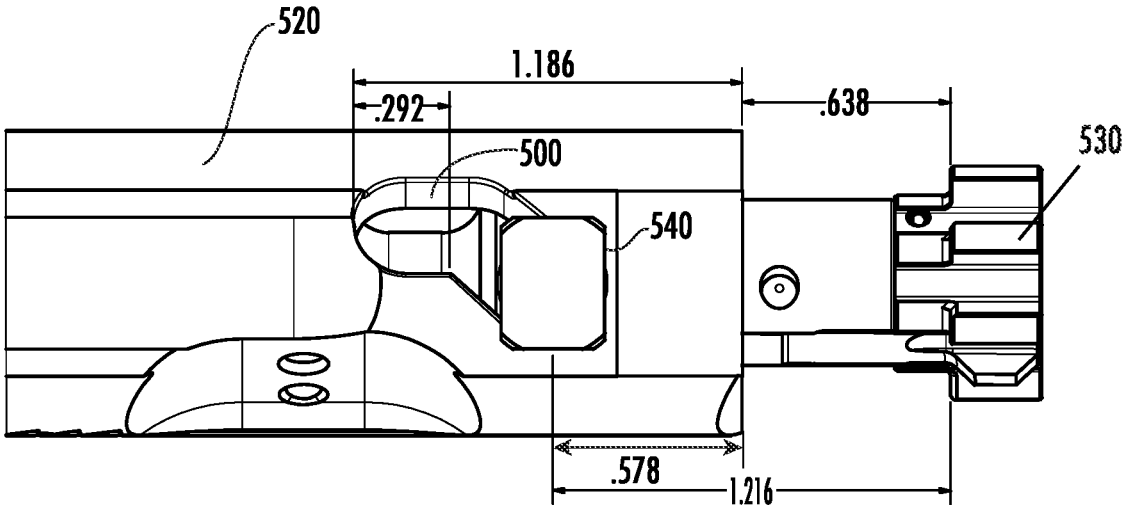

FIG. 1 illustrates a side view of a firearm according to an example embodiment of the present disclosure;

FIG. 2 illustrates a cross-sectional view of a portion of the firearm of FIG. 1 according to an example embodiment of the present disclosure;

FIG. 3 illustrates a partially exploded view of a portion of an example bolt assembly according to an example embodiment of the present disclosure;

FIG. 4A illustrates the profile of a prior art cam slot;

FIG. 4B illustrates a prior art cam slot in relation to a portion of a bolt carrier;

FIG. 4C illustrates a bolt carrier group in a locked configuration in relation to a prior art cam slot;

FIG. 4D illustrates a bolt carrier group in an unlocked configuration in relation to a prior art cam slot;

FIG. 5A illustrates a cam slot according to an example embodiment of the present disclosure;

FIG. 5B illustrates a cam slot according to an example embodiment of the present disclosure in relation to a portion of an exemplary bolt carrier;

FIG. 5C illustrates an exemplary bolt carrier group in a locked configuration in relation to a cam slot according to an example embodiment of the present disclosure; and FIG. 5D illustrates an exemplary bolt carrier group in an unlocked configuration in relation to a cam slot according to an example embodiment of the present disclosure.

DETAILED DESCRIPTION

Some example embodiments of the present disclosure will now be described more fully hereinafter with reference to the accompanying drawings, in which some, but not all, embodiments of the invention are shown. Like reference numerals refer to like elements throughout. Indeed, various embodiments of the present disclosure may be embodied in many different forms and should not be construed as limited to the embodiments set forth herein. Rather, these embodiments are provided so that this disclosure will satisfy applicable legal requirements.

As used herein, the phrases "in one embodiment," "according to one embodiment," "in some embodiments," and the like generally refer to the fact that the particular feature, structure, or characteristic following the phrase may be included in at least one embodiment of the present disclosure. Thus, the particular feature, structure, or characteristic may be included in more than one embodiment of the present disclosure such that these phrases do not necessarily refer to the same embodiment.

As used herein, the word "example" or "exemplary" is used herein to mean "serving as an example, instance, or illustration." Any implementation described herein as "example" or "exemplary" is not necessarily to be construed as preferred or advantageous over other implementations.

As used herein, terms such as "front," "rear," "top," etc. are used for explanatory purposes in the examples provided below to describe the relative position of certain components or portions of components. As used herein, the term "or" is used in both the alternative and conjunctive sense, unless otherwise indicated. The term "along," and similarly utilized terms, means near or on, but not necessarily requiring directly on an edge or other referenced location. The terms "approximately," "generally," and "substantially" refer to within manufacturing and/or engineering design tolerances for the corresponding materials and/or elements unless otherwise indicated. The use of such terms is inclusive of and is intended to allow independent claiming of the specific values listed. Thus, use of any such aforementioned terms, or similarly interchangeable terms, should not be taken to limit the spirit and scope of embodiments of the present invention.

The figures are not drawn to scale and are provided merely to illustrate some example embodiments of the inventions described herein. The figures do not limit the scope of the present disclosure or the appended claims. Several aspects of the example embodiments are described below with reference to example applications for illustration. It should be understood that numerous specific details, relationships, and methods are set forth to provide a full understanding of the example embodiments. One having ordinary skill in the relevant art, however, will readily recognize that the example embodiments can be practiced without one or more of the specific details or with other methods. In other instances, well-known structures and/or operations are not shown in detail to avoid obscuring the example embodiments.

According to embodiments described herein, a chambered round in a firearm (e.g., an AR15 platform rifle, an M16 rifle, AR-10/SR-25/DPMS/LR-308 pattern rifles, H&K 416/417, H&K MR556, FN SCAR, or another rifle sharing a common stock bolt carrier design with other firearms of its type via a corresponding technical design package (TDP)) is fired in a firing action in which a trigger assembly causes the round to discharge and propel a projectile down the barrel with expanding gas. Following the firing action of the firearm, a gas delivery system or other autoloading system may force the bolt carrier group rearward, towards the buttstock relative to the bolt (e.g., in a direct impingement system, by directing the gas to the bolt carrier group to apply force between the bolt and bolt carrier) causing rotation of a bolt of the bolt carrier group about its longitudinal axis and axial disconnection of lugs of the bolt from locking lugs of the barrel. The bolt carrier group is retracted rearward in a cycling action. During this movement, an ejector may apply a force to the cartridge parallel to and offset from the longitudinal axis of the bolt and cartridge to cause the spent cartridge casing to pivot about a notch in the extractor and eject from the firearm via an ejection port once the cartridge clears the lugs of the barrel. The ejector may be offset from the center of mass of the cartridge casing to cause the casing to rotate towards the firearm's ejection port. The extractor may further include an extractor spring configured to impart a force on the extractor body opposite the end of the extractor that engages the cartridge casing that, due to the pivotal engagement between the extractor and the bolt, urges the end of the extractor into engagement with the cartridge casing and further facilitates ejecting of the cartridge casing (e.g., once the spent cartridge casing has cleared the barrel or barrel extension as the bolt moves rearward). The movement of the bolt carrier group to the retracted state further enables a new round to be driven from the magazine to the chamber. The bolt carrier group is biased back toward the barrel by a spring to close the bolt and chamber the new round ready for firing.

The axial and rotational movement of the bolt relative to the bolt carrier is controlled, at least in part, by a cam pin installed on the bolt that travels within a cam pin slot on the bolt carrier. The cam pin slot defines a cam path that the cam pin follows during locking and unlocking of the bolt. In various embodiments discussed herein, the cam pin slot may be elongated towards the buttstock end of the firearm to cause a delay between rearward movement of the bolt carrier and unlocking of the bolt from the lugs beyond the AR15/M16 TDP, which may improve cycling of the firearm and/or reduce wear on the firearm components. Although references and measurements are given herein relative to an AR15/M16, one of ordinary skill in the art will appreciate, in light of the present disclosure, that the teachings herein may be applied to other firearms sharing common dimensions with the AR15/M16 and differing from the AR15/M16, including any of the models and platforms described herein (e.g., AR-10/SR-25/DPMS/LR-308 pattern rifles, H&K 416/417, H&K MR556, FN SCAR, etc.)

With reference to FIG. 1, an example firearm 10 is illustrated depicting relevant components. The firearm 10 of the illustrated embodiment includes a barrel 12, an upper receiver 14, a lower receiver assembly 100; a magazine 106, a grip 110, a trigger guard 102, an action, including a bolt carrier group (e.g., bolt carrier, bolt, firing pin, ejector, etc.) (shown in FIGS. 2-3), an autoloading system (e.g., gas driven system (gas direct gas impingement, gas piston, etc.), recoil-driven autoloader, inertia-driven autoloader, etc.) (not shown), buttstock 16, magazine catch 18, ejection port 17, and/or other firearm components that would be appreciated in light of the present disclosure.

With reference to FIG. 2, according to some embodiments, a magazine 106 may be held in a magazine well 112 defined by a lower receiver of the firearm. In the depicted embodiment, in operation, a bolt carrier group is configured to strip a cartridge 24 from the top of the magazine 106 and feed the cartridge forward and upward into the chamber 26 of the chamber end 12B of the barrel 12 as the firearm cycles. As described herein, the bolt carrier group may include at least a bolt carrier 20, a cam pin 540 (shown in FIG. 5C), a bolt 22 (e.g., described further with reference to FIG. 3), and a firing pin 38. The bolt 22 may then lock with a barrel extension to hold the cartridge 24 in place. The bolt lugs 22A interface with the locking lugs 29 of barrel extension 28 to lock the bolt 22, for example, by inserting the bolt lugs 22A between the barrel extension locking lugs 29 and rotating the bolt 22 about its longitudinal axis to align the rear, buttstock side of the bolt lugs 22A with the forward, muzzle side surface of the barrel extension locking lugs 29. The locking lugs 29 of the barrel extension 28 (or as defined by the barrel 12 in other embodiments) may define an associated clearance as the distance between the innermost surface of the locking lugs 29 to the center axis of the bolt 22 and/or barrel extension 28. The inner surface 30 of the barrel 12 at the chamber 26 may support the cartridge casing during ignition of the cartridge propellent, preventing the cartridge casing from deforming, splitting, or otherwise misfiring during the increase in internal pressure and facilitating direction of the expanding gases behind the bullet to propel the bullet down the bore of the barrel.

Firing of cartridge 24 occurs during actuation of trigger 34 while the bolt carrier group (e.g., including at least the firing pin 38, bolt carrier 20, cam pin 540 (labeled in FIG. 5C) and bolt 22) is in the forward position (e.g., toward the left of FIG. 2), and the bolt lugs 22A are engaged with the barrel extension lugs 29. Actuation of trigger 34 causes disconnector 35 to release hammer 36. The firing pin 38 is driven toward the primer of cartridge 24 when the firing pin 38 is struck by hammer 36, thus firing the chambered cartridge 24. Following a firing action by the firearm 10, in an example embodiment using a direct impingement gas delivery system 32, the gas delivery system directs at least some of the expanding gases generated by firing the chambered cartridge 24 from a gas port at a location at or near the muzzle end back to the bolt carrier group to apply a rearward force to the bolt carrier 20. The bolt carrier 20 then moves rearward while the bolt remains locked for a locked dwell period. After the locked dwell, discussed further below, the bolt 22 is driven into rotation relative to the bolt carrier 20, causing disconnection of the lugs 22A from the locking lugs 29, extraction of the spent cartridge casing from chamber 26, ejection of the spent cartridge from the chamber 26 via the ejection port 17, and resetting the trigger assembly components (e.g., hammer 36, disconnector 35, trigger 34, and other trigger components known in the art).

With reference to FIG. 3, an exploded view of a bolt 22 is illustrated. The bolt 22 is configured to be translationally and rotatably mounted in the bolt carrier and limited in its motion relative to the bolt carrier by the cam pin, which inserts into the cam slot of the bolt carrier. The bolt 22 may define a plurality of bolt lugs 22A disposed at the forward, muzzle end of the bolt 22 configured to engage and releasably interlock with a plurality of locking lugs 29 of barrel extension 28 (shown in FIG. 2) to lock the bolt 22, as described above. Each set of lugs may have a muzzle side and a buttstock side corresponding to the location closest to the respective sides of the lugs (e.g., as shown in the complete assembly of FIG. 2). The bolt 22 may also define a groove 23 (e.g., slot, channel, recess, etc.) configured to receive the extractor 300 therein such that the extractor 300 may engage/disengage and guide a cartridge casing as described above.

A cam pin 40 (labeled 540 in FIG. 5C) inserts into a cam pin opening 304 in the bolt 22, and is secured to the bolt during operation. When assembled, the cam pin 540 extends from the bolt 22 and through a cam slot 500 (shown in FIG. 5A) defined in the bolt carrier, the cam slot 500 defining a path within which movement of the cam pin 540 is constrained. The cam pin movement, in turn, controls the movement of the bolt during operation. That is, the rotational and translational movement required to engage and releasably interlock the bolt lugs 22A with the locking lugs 29 (i.e., to lock and unlock the bolt 22) is regulated by interaction of the cam pin 540 with the cam slot 500 (shown in FIG. 5A). As the cam pin 540 moves along a length of the bolt carrier during operation of the firearm, the cam pin 540 rotates around a longitudinal axis of the bolt (e.g., the axis extending lengthwise along the bolt 22 between the muzzle and buttstock of the firearm), and the bolt, in turn, rotates around its longitudinal axis so that the bolt lugs can lock or unlock with the locking lugs. The bolt is incapable of rearward movement when the bolt lugs are interlocked with the corresponding locking lugs.

With reference to FIG. 4A, the profile of a prior art standard cam slot 400 for the respective weapons platform is depicted in accordance with the M16/AR15 TDP. The cam slot 400 includes a forward, muzzle end edge 402, an unlocked dwell 404, a transition section 406, a locked dwell 408, and a rearward, buttstock end edge 410. The locked and unlocked dwells are sections of the cam slot 400 configured to provide forward and rearward translational linear movement of a cam pin (and in turn, the bolt) relative to the bolt carrier without rotational movement. That is, the locked dwell 408 allows for back-and-forth movement of the bolt carrier without rotation of the bolt while the bolt is still locked in battery (e.g., engaged with the lugs of the barrel extension) and the unlocked dwell 404 allows for back-and-forth movement of the bolt carrier relative to the bolt without rotation while the bolt is unlocked from the lugs (e.g., when locking, during a period from contact of the bolt against the barrel and locking of the lugs via rotation of the bolt, and when unlocking, during a period from unlocking of the lugs to rearward lateral movement of the bolt relative to the barrel when the bolt reaches the end of the unlocked dwell of the cam slot). The transition section 406 of the cam slot located between the locked and unlocked dwells imparts rotational movement to the cam pin (and in turn, the bolt) during translational movement of the bolt carrier, allowing the bolt to rotate around its longitudinal axis so that the bolt lugs can lock or unlock with the locking lugs. In operation, the cam pin may contact the angled sides 412*a*, 412*b* of the transition section 406 to impart the rotational movement on the bolt while the bolt and bolt carrier continue to move axially relative to each other.

For example, during an unlocking movement as the cam pin moves along the locked dwell 408 toward the transition section 406, the cam pin contacts the first angled side 412*a*, which rotates the bolt as the cam pin moves along the side towards the unlocked dwell 404. When the cam pin reaches the unlocked dwell 404 the rotation of the bolt stops and the bolt carrier continues moving translationally relative to the bolt until the unlocking is complete (e.g., when the cam pin travels to or proximate a muzzle end of the cam slot) and the bolt and bolt carrier are moving rearward together. In reverse, during a locking movement as the cam pin moves along the unlocked dwell 404 toward the transition section 406 (e.g., after the bolt contacts the barrel), the cam pin contacts the second angled side 412*b*, which rotates the bolt as the cam pin moves along the side towards the locked dwell 408. When the cam pin reaches the locked dwell 408 the rotation of the bolt stops and the bolt carrier continues moving translationally relative to the bolt until the cam pin is in the locked position (e.g., at or proximate a buttstock end of the cam slot).

The TDP standard for the M16/AR15 has a standard cam slot 400 that includes a locked dwell 408 of 0.070 inches. The actual delay on a standard AR system is approximately 0.044 inches long when accounting for the distance traveled by the cam pin within the cam slot during operation. The unlocked dwell 404 of a standard cam slot 400 is 0.042 inches. The transition section of a standard cam slot 400 comprises two parallel sides 412*a*, 412*b* defining a width of the transition section, the width of the transition section being defined perpendicular to the parallel sides and being approximately 0.3165 inches.

With reference to FIG. 4B, the cam slot 400 of FIG. 4A is shown cut into an example bolt carrier 420. In the depicted embodiment, the cam slot 400 extends longitudinally along and circumferentially around a portion of the bolt carrier 420 and is cut between the exterior of the bolt carrier to an interior of the bolt carrier where a portion of the bolt is housed. The forward, muzzle side edge 402 of the cam slot 400 is located toward the muzzle end of the firearm (e.g., toward the right of FIG. 4B) and the rearward, buttstock side edge 410 of the cam slot 400 is located toward the buttstock end of the firearm (e.g., toward the left of FIG. 4B). In the depicted embodiments of FIGS. 4A and 4B, measurements are shown from a center of the circular profiles of the extreme ends of the cam slot 400 (e.g., according to where a mill tool would be inserted for cutting). For example, the 0.070 inch slot length of the locked dwell is measured in the drawing from the center of the semi-circular profile at the buttstock end of the cam slot 400 to the rightmost edge of the slot as the tool path would begin to angle along the transition section. Similarly, the slot length of the unlocked dwell is measured in the drawing from the center of the semi-circular profile at the muzzle end of the cam slot 400 to the leftmost edge of the slot as the tool path would begin to angle along the transition section.

With reference to FIG. 4C, the bolt carrier group is shown in battery with the cam pin 440 in the locked position, such that the one or more bolt lugs 430 are interlocked with the corresponding locking lugs (not shown) and the bolt 422 is incapable of rearward movement (e.g., a locked configuration). When the bolt carrier group is in such a locked configuration, the cam pin 440 is positioned at the rearward, buttstock end of the cam slot 400 in the locked dwell and the bolt 422 is in a retracted position relative to the bolt carrier 420. In such a locked configuration, the length from the center of the cam pin 440 to the forward edge of the bolt carrier 420 is 0.938 inches and the length from the forward edge of the bolt carrier 420 to the rearward edge of the bolt lugs 430 in the retracted position is 0.214 inches in accordance with the TDP. As depicted, the longitudinal distance between the locked dwell and unlocked dwell is inches, and the distance between the unlocked position and the front of the bolt carrier is inches.

With reference to FIG. 4D, the bolt carrier group is out of battery with the cam pin 440 in the unlocked position, such that the bolt lugs 430 are no longer interlocked with the locking lugs (not shown) and the bolt is capable of rearward movement (e.g., an unlocked configuration). When the bolt carrier group is in such an unlocked configuration, the cam pin 440 is positioned at the forward, muzzle end of the cam slot 400 in the unlocked dwell and the bolt 422 is in extended position relative to the bolt carrier 420. In such an unlocked configuration, the length from the center of the cam pin 440 to the forward edge of the bolt carrier 420 is 0.640 inches, the length from the forward edge of the bolt carrier 420 to the rearward edge of the bolt lugs 430 in the extended position is 0.512 inches, and the length from the rearward edge 410 of the cam slot 400 to the forward edge of the bolt carrier is 1.123 inches in accordance with the TDP.

As the bolt transitions between the locked configuration to an unlocked configuration (e.g., from "in battery" to "out of battery"), the cam pin 440 travels 0.298 inches from the locked dwell 408 through the transition section 406 of the cam slot 400 into the unlocked dwell 404. In the transition section 406 of the cam slot 400, the cam pin 440 contacts and slides along the sides of the transition section 440, causing the bolt 422 to rotate about (e.g., approximately 22.5° about the longitudinal axis of the bolt) and translate along the longitudinal axis of the bolt carrier 420.

Similarly, as the bolt 422 transitions between the unlocked configuration to the locked configuration (e.g., from "out of battery" to "in battery"), the cam pin 440 travels 0.298 inches from the unlocked dwell 404 through the transition section 406 of the cam slot 400 into the locked dwell 408. In the transition section 406 of the cam slot 400, the cam pin 440 contacts and slides along the sides of the transition section 406, causing the bolt 422 to rotate about in the opposite direction (e.g., approximately 22.5° about the longitudinal axis of the bolt) and translate along the longitudinal axis of the bolt carrier 420.

The inventors have determined and discovered that it would be desirable and advantageous to retain portions of the general profile of the standard TDP cam slot, while modifying several features to produce new unforeseen advantages. In some embodiments of the present cam slot, the locked dwell is extended relative to the standard cam slot to a length greater than 0.070 inches. That is, in some embodiments, the profile of an improved cam slot includes an extended locked dwell but otherwise corresponds to TDP dimensions for a standard cam slot of the firearm. For example, in some embodiments, the locked dwell is lengthened by approximately 0.125 inches.

In some embodiments, the cam slot is additionally or alternatively shifted forward toward the muzzle end relative to the standard cam slot location. For example, the location of the forward edge of the cam slot (e.g., 402 in FIG. 4B) may be closer to the forward edge of the bolt carrier than a TDP cam slot. For example, in some embodiments, the cam slot is shifted forward relative to the bolt carrier such that the length from the center of the cam pin to the forward edge of the bolt carrier in the unlocked configuration is 0.578 inches instead of the standard dimension of 0.640 inches. In still further embodiments, the location of the cam pin on the bolt is adjusted rearward relative to the location of the cam pin according to TDP standards such that the bolt extends further from the bolt carrier in the unlocked configuration than relative to a cam slot milled according to TDP standards. In some embodiments, a rearward shift of the cam pin on the bolt, a forward shift of the cam slot, and a lengthening of the locked dwell of the cam slot may combine to cause the bolt carrier to be the same distance from the lugs of the bolt in the locked position as in a standard TDP bolt carrier group (e.g., 0.214 inches in both situations). In some embodiments, the barrel extension lugs and interaction between the bolt carrier group and the barrel assembly may define the final position of the bolt carrier as described below.

The extended locked dwell enables a longer delay period than a standard cam slot during unlocking of the bolt at the start of the unlocking of the bolt after firing of a round with the firearm. Accordingly, in at least some embodiments, the initiation of the unlocking motion in the modified cam slot embodiments disclosed herein is delayed compared to a standard cam slot in accordance with TDP dimensions. That is, the start of the rotational movement of the cam pin due to the engagement of the cam pin with the transition section is delayed due to the elongated axial portion of the locked dwell. Such delay may allow for gas to escape from the barrel and a reduction of pressure in the chamber/barrel, which may allow the cartridge to relax and reduce pressure on the bolt from within the chamber. Such reduced pressure and relaxation of the cartridge may improve unlocking of the bolt and extraction of the cartridge due to lower resistance from the cartridge against the chamber walls. In some embodiments, because there is reduced pressure upon extraction as compared to standard TDP, there may be a reduced chance of the cartridge primer being pushed out of the case and into the action of the firearm, which could cause the firearm to jam. In addition, there may be less wear on the chamber, barrel, barrel extension, bolt, bolt carrier, and other moving components of the firearm due to the reduced internal forces from residual gas pressure in the chamber barrel, thereby enabling smoother, longer lasting, and more consistent operation of the firearm. Some embodiments of the present system may be particularly useful for "hot rounds" and other larger and/or more forceful cartridges that may benefit from additional pressure dispersal during cycling (e.g., 5.56 NATO, 223 Remington, 6MM ARC, 7.62×39, 6.5 Grendel, and 6.8×51/277 SIG FURY). The extended locked dwell may increase the cycling time of the firearm.

With reference to FIG. 5A, an example embodiment of a modified cam slot 500 of the present disclosure is illustrated. The modified cam slot 500 includes a forward, muzzle side edge 502, an unlocked dwell 504, a transition section 506, an extended locked dwell 508, and a rearward, buttstock side edge 510. The extended locked dwell 508 and the unlocked dwell 504 are designed to provide forward and rearward linear movement of a cam pin (and in turn, the bolt) without rotational movement. The extended locked dwell 508 increases the length of the standard locked dwell. For example, as depicted, in some embodiments, the extended locked dwell 508 increases the length of the standard locked dwell of the cam slot (i.e., 0.070 inches). For example in some embodiments, the extended locked dwell is approximately 0.125 inches greater than the standard locked dwell (e.g., 0.195 inches). In such embodiments, the actual delay on an AR15/M16 system according to embodiments of the present disclosure is approximately inches long when accounting for the distance traveled by the cam pin within the cam slot during operation (e.g., 0.125 inches greater than the standard 0.044 inch delay). In some embodiments, the increased locked dwell may be at least partially due to the cam pin being farther back along the bolt than a typical bolt. In some embodiments, the increased locked dwell may be at least partially due to the cam slot being farther forward on the bolt carrier than a typical bolt carrier. In some embodiments, the increased locked dwell may be at least partially due to the locked dwell region of the cam slot being longer than a typical bolt carrier. In some embodiments, the increased locked dwell may be at least partially due to the cam slot being both longer and being farther forward on the bolt carrier than a typical bolt carrier. In some embodiments, the increased locked dwell may be at least partially due to the cam slot being longer and being farther forward on the bolt carrier than a typical bolt carrier and the cam pin being farther back along the bolt than a typical bolt.

In some embodiments, the extended locked dwell 508 is manufactured by axially milling (along the longitudinal axis of the bolt carrier) the locked dwell portion 508 of the cam slot 500 longer than the standard cam slot 400. For example, in some embodiments, the extended locked dwell 508 is manufactured by milling a cam path in a bolt carrier to define the unlocked dwell 504, the transition section 506, and the locked dwell 508 of a modified cam slot 500, including axially milling toward or from the buttstock end of the firearm a greater distance such that the locked dwell 508 is greater than the standard locked dwell 408 of 0.070 inches. For example, in some embodiments, milling the extended locked dwell 508 comprises axially milling a locked dwell 508 portion 0.125 inches longer than in a standard cam slot, such that the extended locked dwell 508 is approximately 0.195 inches. The milling may, in some embodiments, be made with a single cut to define a single cut path. In some embodiments, the cam slot may be milled in a front-to-back direction, such that the cut is made from the unlocked dwell 504 to the transition section 506 and then to the locked dwell 508, with the locked dwell 508 extending greater than 0.070 inches in the longitudinal direction after the cutting tool discontinues the rotational movement that defined the transition section 506. In some embodiments, the cam slot may be milled from back-to-front, such that the cut is made from the locked dwell 508 starting greater than 0.070 inches from the start of the transition section 508, then to the transition section 506, and then to the unlocked dwell 504. Such milling provides a distance between the rearward edge 510 of the modified cam slot 500 and a start of the transition section 506 of approximately 0.292 inches. In some embodiments, the transition section of the cam slot 500 may include two parallel sides 512*a*, 512*b* defining a width of the transition section. In some embodiments, the width of the transition section may be defined perpendicular to the parallel sides and may be approximately 0.3165 inches (e.g., equal to the width of the standard cam slot 400). In some embodiments, 0.3165 inches may correspond to the width of the milling tool bit. In some embodiments, each side 512*a*, 512*b* may be the same length as a standard cam slot 400. In still further embodiments, milling the cam path comprises milling the cam path in accordance with a standard AR15/M16 manufacturing process but for the locked dwell and/or relative positioning of the cam slot on the bolt carrier.

The transition section 506 of the modified cam slot 500 located between the extended locked dwell 508 and the unlocked dwell 504 imparts rotational movement to the cam pin 540 (and in turn, the bolt 522) during translational movement of the bolt carrier 520 relative to the bolt 522, allowing the bolt to rotate around its longitudinal axis while the bolt carrier and bolt move relative to each other so that the one or more bolt lugs 530 can lock or unlock with the locking lugs (not shown). The sides 512*a*, 512*b* may drive rotation of the bolt as the bolt carrier moves relative to the bolt via contact between the sides and the cam pin. For example, during an unlocking movement as the cam pin moves along the extended locked dwell 508 toward the transition section 506, the cam pin contacts the first angled side 512*a*, which rotates the bolt as the cam pin moves along the side towards the unlocked dwell 504. When the cam pin reaches the unlocked dwell 504, the rotation of the bolt stops, and the bolt carrier continues moving translationally relative to the bolt until the unlocking is complete and the bolt and bolt carrier are moving rearward together. In reverse, during a locking movement as the cam pin moves along the unlocked dwell 504 toward the transition section 506 (e.g., after the bolt contacts the barrel), the cam pin contacts the second angled side 512*b*, which rotates the bolt as the cam pin moves along the side towards the locked dwell 508. When the cam pin reaches the locked dwell 508, the rotation of the bolt stops, and the bolt carrier continues moving translationally relative to the bolt until the cam pin is in the locked position.

With reference to FIG. 5B, the modified cam slot 500 extends longitudinally along and circumferentially around a portion of the bolt carrier 520. The forward edge 502 of the modified cam slot 500 is located toward the muzzle end of the firearm (e.g., toward the right of FIG. 5B) and the rearward edge 510 of the cam slot 500 is located toward the butt end of the firearm (e.g., toward the left of FIG. 5B).

With reference to FIG. 5C, the bolt carrier group is "in battery" such that the bolt lugs 530 are interlocked with the corresponding locking lugs (not shown) of the barrel/barrel extension and the bolt carrier group is incapable of rearward movement (e.g., a locked configuration). When the bolt carrier group is in such a locked configuration, the cam pin 540 is positioned at the rearward end of the modified cam slot 500 in the extended locked dwell 508 and the bolt 522 is in a retracted position relative to the bolt carrier 520. In such a locked configuration, the length from the center of the cam pin 540 to the forward edge of the bolt carrier 520 is 1.002 inches and the length from the forward edge of the bolt carrier 520 to the rearward edge of the bolt lugs 530 in the retracted position is 0.214 inches in accordance with the TDP. In some embodiments, the cam slot 500 itself may not define the final position of the cam pin 540 by contact. For example, the locked distance between the bolt carrier 520 and the front of the bolt 530 may be independent of the cam slot. For example, the barrel extension lugs interacting with the bolt lugs may create the depicted 0.214 inch dimension. In some embodiments, the cam slot may include a small amount of extra slot distance so that it doesn't influence the end point.

With reference to FIG. 5D, the bolt carrier group is "out of battery" such that the bolt lugs 530 are no longer interlocked with the locking lugs (not shown) and the bolt carrier group is capable of rearward movement toward the buttstock end (e.g., an unlocked configuration). When the bolt carrier group is in such an unlocked configuration, the cam pin 540 is positioned at the forward, muzzle end of the modified cam slot 500 in the unlocked dwell 504 and the bolt 522 is in an extended position relative to the bolt carrier 520.

With continued reference to FIG. 5D, in some embodiments, the forward, muzzle side edge of the modified cam slot 500 can be moved forward relative to the bolt carrier 520 as compared to a stock bolt carrier and cam slot. For example, in some embodiments, the forward edge of the modified cam slot 500 can be moved forward relative to the bolt carrier 520 such that the length from the center of the cam pin 540 to the forward edge of the bolt carrier 520 in the unlocked configuration is 0.578 inches. In some embodiments, the length from the rearward edge 510 of the modified cam slot 500 to the forward edge of the bolt carrier is 1.186 inches. In certain embodiments, the bolt 22 (as depicted in FIG. 3) is also lengthened as compared to a standard bolt.

With reference back to FIG. 3, in some embodiments, the cam pin 40 is located further rearward on the bolt 22 as compared to a standard cam pin and bolt configuration. In some embodiments, the cam pin 40 is located farther from the muzzle end of the bolt 22 as compared to a standard cam pin and bolt configuration. For example, in some embodiments, the cam pin 40 is located 0.064 inches rearward on the bolt 22 as compared to a standard cam pin and bolt configuration. In some embodiments, as described below, the cam slot may be moved forward approximately 0.62 inches for an increase of 0.125 inches or 0.126 inches. Accordingly, in certain embodiments, the bolt 22 may extend further relative to the forward end of the bolt carrier 520 (shown in FIG. 5D) in the unlocked configuration. In some embodiments, the length from the forward, muzzle side edge of the bolt carrier 520 to the rearward, buttstock side edge of the bolt lugs 530 in the extended position is 0.638 inches, as depicted in FIG. 5D. The lugs may be the same thickness as TDP. The bolts 22, 522 shown respectively in FIG. 3 and FIGS. 5B-5D may be the same.

As the bolt 522 transitions from the locked configuration to an unlocked configuration (e.g., from "in battery" to "out of battery") in accordance with exemplary embodiments of the present disclosure, the cam pin 540 may travel a further distance as compared to the standard cam pin slot 400. For example, in some embodiments wherein the extended locked dwell 508 increases the length of the standard locked dwell 408 (i.e., 0.070 inches) by approximately 0.125 inches (e.g., approximately 0.195 inches of extended locked dwell), the cam pin 540 may travel approximately 0.424 inches along the longitudinal direction, irrespective of rotation, from the extended locked dwell 508 through the transition section 506 of the modified cam slot 500 into the unlocked dwell 504, where the cam pin 540 reaches the unlocked position of the modified cam slot 500. In the transition section 506 of the modified cam slot 500, the cam pin 540 contacts and slides along the sides 512*a*, 512*b* of the transition section 506, causing the bolt 522 to rotate about (e.g., approximately 22.5°) and translate along the longitudinal axis of the bolt carrier 520.

Similarly, as the bolt 522 transitions from the unlocked configuration to the locked configuration (e.g., from "out of battery" to "in battery"), in accordance with exemplary embodiments of the present disclosure, the cam pin 540 may travel a further distance as compared to the standard cam pin slot 400. For example, in some embodiments wherein the extended locked dwell 508 increases the length of the standard locked dwell (i.e., 0.070 inches) by approximately 0.125 inches (e.g., approximately 0.195 inches of extended locked dwell), the cam pin 540 may travel 0.424 inches along the longitudinal direction, irrespective of rotation, from the unlocked dwell 504 through the transition section 506 of the modified cam slot 500 into the extended locked dwell 508, where the cam pin 540 reaches the locked position of the modified cam slot 500 (e.g., at or proximate a buttstock end of the cam slot). In the transition section 506 of the modified cam slot 500, the cam pin 540 may contact and slides along the sides 512*a*, 512*b* of the transition section 506, causing the bolt 522 to rotate about in the opposite direction (e.g., approximately 22.5°) and translate along the longitudinal axis of the bolt carrier 520.

During manufacturing, as described herein, the cam slot may be formed by subtractive manufacturing. For example, in some embodiments, the cam slot may be formed using different machining tools such as a lathe, a multi-axis turning center, a 4-axis milling machine, or a 5-axis milling machine. In some embodiments, the cam slot may be formed by milling the slot into the bolt carrier. In some embodiments, the milling bit may cut through the bolt carrier from an exterior to an interior and along the cam path to form the cam slot. In some embodiments, the cut path of the cam slot is controlled via a CNC control that controls each axis relative to each other. In still other embodiments, a tracer attachment may be used. In some embodiments, the cam slot may be cut with a single cut. The "single cut" may refer to the resulting shape (e.g., one that could be made with a single path of the cutting tool) than the actual process used to manufacture any particular cam slot or the number or portions of cutting tool passes required over the same path. For example, a "single cut" cam slot may refer to a slot that defines an at least approximately consistent width along its entire length. The milling tool may be run in one or more directions along the tool path to form any of the structures described herein. In still further embodiments, a milling bit or cutter is smaller the cam slot to be formed such that the milling bit/cutter runs a path along both sides in forming the cam slot.

The embodiments described herein may also be scalable to accommodate at least the aforementioned applications such as with respect to different size and configurations of firearms and different types of cartridges. Various components of embodiments described herein can be added, removed, reorganized, modified, duplicated, and/or the like as one skilled in the art would find convenient and/or necessary to implement a particular application in conjunction with the teachings of the present disclosure. Moreover, specialized features, characteristics, materials, components, and/or equipment may be applied in conjunction with the teachings of the present disclosure as one skilled in the art would find convenient and/or necessary to implement a particular application in light of the present disclosure.

Many modifications and other embodiments of the present disclosure set forth herein will come to mind to one skilled in the art to which this disclosure pertains having the benefit of the teachings presented in the foregoing descriptions and the associated drawings. Therefore, it is to be understood that the present disclosure is not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated, in light of the present disclosure, that different combinations of elements and/or functions can be provided by alternative embodiments without departing from the scope of the appended claims. In this regard, for example, different combinations of elements and/or functions than those explicitly described above are also contemplated as can be set forth in some of the appended claims. Although specific terms are employed herein, they are used in a generic and descriptive sense only and not for purposes of limitation.

That which is claimed:

1. A bolt carrier for a firearm, the bolt carrier defining:

a cam slot configured to receive a cam pin of a bolt, the cam slot being defined between an interior of the bolt carrier and an exterior of the bolt carrier, wherein the interior of the bolt carrier is configured to receive at least a portion of the bolt therein and to permit the bolt to translate along and rotate about a first axis of the bolt carrier, wherein the cam slot is configured to constrain the translation and rotation of the bolt, the cam slot defining a cam path along which the cam pin is configured to travel, the cam path comprising a locked dwell, an unlocked dwell, and a transition section disposed between the locked dwell and the unlocked dwell, wherein an axial length of the transition section is consistent with a standard transition section of an AR15 or M16 Technical Data Package, and wherein the locked dwell defines a portion parallel to the first axis that is greater than inches long.

2. The bolt carrier of claim 1, wherein the cam slot is shaped according to the AR15 or M16 Technical Data Package except the locked dwell and a relative position of the cam slot on the bolt carrier.

3. The bolt carrier of claim 1, wherein the locked dwell is greater than a standard locked dwell.

4. The bolt carrier of claim 3, wherein the locked dwell is approximately 0.195 inches.

5. The bolt carrier of claim 1, wherein the cam slot is a single cut cam slot between a muzzle end of the cam slot and a buttstock end of the cam slot, and wherein the unlocked dwell is formed via a linear cut path on a second axis parallel to the first axis, wherein the locked dwell is formed via a linear cut path on a third axis parallel to the first axis, and wherein the transition section is formed via a cut path between the second axis and the third axis.

6. The bolt carrier of claim 1, wherein the transition section comprises two parallel sides defining a width of the transition section, the width of the transition section being approximately equal to a width of the locked dwell.

7. The bolt carrier of claim 1, wherein a distance between a buttstock end of the cam slot and a start of the transition section is 0.292 inches.

8. A firearm comprising:

a barrel assembly comprising a barrel or a barrel extension defining one or more locking lugs;

an upper receiver connected to the barrel assembly;

a bolt carrier group disposed within the upper receiver, the bolt carrier group comprising:

a bolt carrier defining an interior and a cam slot, the cam slot being defined between the interior of the bolt carrier and an exterior of the bolt carrier; and a bolt defining one or more bolt lugs configured to engage with the one or more locking lugs of the barrel assembly, wherein a cam pin is operably coupled to the bolt;

wherein at least a portion of the bolt is disposed in the interior of the bolt carrier to permit the bolt to translate along and rotate about a first axis of the bolt carrier, wherein the cam slot is configured to constrain the translation and rotation of the bolt, the cam slot defining a cam path along which the cam pin is configured to travel, the cam path comprising a locked dwell, an unlocked dwell, and a transition section disposed between the locked dwell and the unlocked dwell, wherein an axial length of the transition section is consistent with a standard transition section of an AR15 or M16 Technical Data Package, and wherein the locked dwell defines a portion parallel to the first axis that is greater than inches long.

9. The firearm of claim 8, wherein the cam pin is disposed farther from the one or more bolt lugs than a standard cam pin.

10. The firearm of claim 8, wherein in operation, the bolt is configured to move between a locked position and an unlocked position, wherein in the locked position, the cam pin is configured to be disposed at or proximate a buttstock end of the cam slot, and wherein in the unlocked position, the cam pin is configured to be disposed at or proximate a muzzle end of the cam slot.

11. The firearm of claim 10, wherein in the locked position, the cam pin is disposed approximately 1.002 inches from a muzzle end of the bolt carrier.

12. The firearm of claim 10, wherein in the locked position, a muzzle end of the bolt carrier is disposed approximately 0.214 inches from a buttstock side of the one or more bolt lugs.

13. The firearm of claim 10, wherein the cam pin is configured to travel at least inches along the first axis between the locked position and the unlocked position.

14. The firearm of claim 8, wherein the cam slot is disposed closer to a muzzle end of the bolt carrier than a standard cam slot.

15. The firearm of claim 8, wherein the cam slot is structured according to the AR15 or M16 Technical Data Package except the locked dwell and a relative position of the cam slot on the bolt carrier.

16. The firearm of claim 8, wherein the locked dwell is greater than a standard locked dwell.

17. A method of manufacturing a bolt carrier, the method comprising:

milling a cam slot into a bolt carrier, wherein the cam slot is configured to receive a cam pin of a bolt, the cam slot being milled between an interior of the bolt carrier and an exterior of the bolt carrier, wherein the interior of the bolt carrier is configured to receive at least a portion of the bolt therein and to permit the bolt to translate along and rotate about a first axis of the bolt carrier, wherein the cam slot is configured to constrain the translation and rotation of the bolt, the cam slot defining a cam path along which the cam pin is configured to travel, the cam path comprising a locked dwell, an unlocked dwell, and a transition section disposed between the locked dwell and the unlocked dwell, wherein an axial length of the transition section is consistent with a standard transition section of an AR15 or M16 Technical Data Package, and wherein the locked dwell defines a portion parallel to the first axis that is greater than 0.070 inches long.

18. The method of claim 17, wherein milling the cam slot into the bolt carrier comprises making a single cut cam slot between a muzzle end of the cam slot and a buttstock end of the cam slot.

19. The method of claim 18, wherein the unlocked dwell is formed via a linear cut path on a second axis parallel to the first axis, wherein the locked dwell is formed via a linear cut path on a third axis parallel to the first axis, and wherein the transition section is formed via a cut path between the second axis and the third axis.

20. The bolt carrier of claim 1, wherein a distance between a muzzle end of the cam slot is less than the AR15 or M16 Technical Data Package, and wherein the unlocked dwell defines a portion parallel to the first axis that is consistent with a standard unlocked dwell of the AR15 or M16 Technical Data Package.

* * * * *